US009020164B2

(12) United States Patent
Silberman et al.

(10) Patent No.: US 9,020,164 B2
(45) Date of Patent: Apr. 28, 2015

(54) APPARATUS TO MITIGATE EAR PRESSURE ON AIRLINE FLIGHTS WHILE PRESERVING AWARENESS OF THE CABIN SURROUNDINGS

(71) Applicants: Tamar Silberman, Haifa (IL); Gabriel Silberman, Hastings on Hudson, NY (US)

(72) Inventors: Tamar Silberman, Haifa (IL); Gabriel Silberman, Hastings on Hudson, NY (US)

( * ) Notice: Subject to any disclaimer, the term of this patent is extended or adjusted under 35 U.S.C. 154(b) by 0 days.

(21) Appl. No.: 14/010,607

(22) Filed: Aug. 27, 2013

(65) Prior Publication Data

US 2014/0301561 A1 Oct. 9, 2014

Related U.S. Application Data

(60) Provisional application No. 61/810,224, filed on Apr. 9, 2013.

(51) Int. Cl.
*H04R 15/00* (2006.01)
*H04R 1/10* (2006.01)

(52) U.S. Cl.
CPC ..... *H04R 1/1091* (2013.01); *H04R 1/1008* (2013.01)

(58) Field of Classification Search
USPC ..... 381/73.1, 71.1, 94.1, 375, 26
See application file for complete search history.

(56) References Cited

U.S. PATENT DOCUMENTS

| | | | | |
|---|---|---|---|---|
| 5,361,304 | A * | 11/1994 | Jones et al. | 381/72 |
| 5,604,813 | A * | 2/1997 | Evans et al. | 381/71.6 |
| 6,970,571 | B2 * | 11/2005 | Knorr et al. | 381/370 |
| 7,715,568 | B2 * | 5/2010 | Nakano | 381/17 |
| 2010/0189277 | A1 * | 7/2010 | Birgersson | 381/73.1 |

* cited by examiner

*Primary Examiner* — Davetta W Goins
*Assistant Examiner* — Amir Etesam
(74) *Attorney, Agent, or Firm* — John S. Economou

(57) ABSTRACT

Two ear cups are coupled by a flexible member. Each ear cup includes a speaker mounted on an internal portion thereof and is configured to form an air pressure seal around an ear of a user when the apparatus is placed on the user. The flexible member couples the two ear cups and ijs configured such that, when the apparatus is placed on the user, each ear cup completely covers an associated ear of the user and forms an air pressure seal around the associated ear. A microphone is electrically coupled to the speaker in each ear cup for transmitting ambient sound to the user when the apparatus is placed on the user. An indicator light may be provided which is configured to turn on when the microphone is active. The microphone and/or the indicator light may be mounted on the flexible member or on one of the ear cups.

3 Claims, 12 Drawing Sheets

APPARATUS TO MITIGATE EAR PRESSURE ON AIRLINE FLIGHTS WHILE PRESERVING AWARENESS OF THE CABIN SURROUNDINGS

CROSS REFERENCE TO RELATED APPLICATIONS

This application claims the benefit of the filing date of U.S. Provisional Patent Application No. 61/810,224, entitled APPARATUS TO MITIGATE EAR PRESSURE ON AIRLINE FLIGHTS WHILE PRESERVING AWARENESS OF THE CABIN SURROUNDINGS and filed on Apr. 9, 2013.

FIELD OF INVENTION

This invention relates generally to diminishing the ear discomfort caused by the change in air pressure when an airplane changes altitudes.

BACKGROUND OF THE INVENTION

The change in altitude of an airplane, particularly during descent towards landing, causes ear pain in many air travelers. While this pain is not considered dangerous, it is extremely uncomfortable and particularly unsettling for babies and young children. If the air traveler suffers from a respiratory ailment such as a cold or severe allergy, the pain may be severe and/or persist for several days after a flight, if the pressure in the ears fails to equalize upon landing.

The small space in the middle ear behind the eardrum, connected to the back of the nose via a small channel (the Eustachian tube), is normally filled with air. Under normal circumstances, the air on either side of the eardrum is at the same pressure, but as a plane descends the cabin air pressure outside the ear rises relatively fast, while the air pressure in the middle ear does not. The difference in air pressures pushes the eardrum inwards resulting in discomfort and possibly pain. To counter this problem several tricks can be used to raise the air pressure in the middle ear to equal that of the plane's cabin, such as yawning, chewing gum, or using the Valsalva technique: with mouth closed, gently pinch nostrils closed and then push air into nasal passages as if blowing nose. Another approach is to shield the ears from the increase in air pressure, thus avoiding the differences in pressure until normal breathing has given the passenger a chance to bring up the middle ear air pressure naturally.

You may have witnessed flight attendants suggest to passengers the use of plastic cups to cover their ears to diminish the discomfort. What the plastic cups are accomplishing is simply keeping the rising air pressure from pushing against the passenger's eardrum. But this is not easy to accomplish when young children are involved, as they do not sit still because of the discomfort. Furthermore, when adults are concerned, covering their ears may interfere with their ability to hear instructions from the pilot or passenger cabin crew, which would put them at risk in case of an emergency. As a matter of fact, airline and other regulations may prohibit the use of earphones during takeoff and landing to ensure all announcement can be clearly heard by the passengers.

It is an object of the present invention to show an apparatus to cover a person's ears in a way that isolates it from external air pressure, while at the same time allowing the person to hear the sounds in their surroundings. Moreover, the apparatus features a highly visible signal showing its status as properly transmitting sounds.

SUMMARY OF THE INVENTION

The present invention provides an apparatus comprising a pair of ear cups coupled via a flexible member. Each ear cup includes a speaker mounted on an internal portion thereof and is configured to form an air pressure seal around an ear of a user when the apparatus is placed on the user. The flexible member couples the two ear cups and is configured such that, when the apparatus is placed on the user, each ear cup completely covers an associated ear of the user and forms an air pressure seal around the associated ear. Finally, a microphone is electrically coupled to the speaker in each ear cup for transmitting ambient sound to the user when the apparatus is placed on the user. The microphone may be mounted on the flexible member or on one of the ear cups. An indicator light may be provided which is configured to turn on when the microphone is active. The indicator light may be an LED device mounted on the flexible member or on one of the ear cups.

The apparatus may further include a cable for connecting to an external audio playback device such that the speakers are coupled to the external audio playback device instead of the microphone when the cable is coupled to the external audio playback device.

The apparatus may further include an input for coupling to external headphones and wherein the microphone is configured to transmit ambient sound to the user via the external headphones when a cable for the headphones is coupled to the input.

The apparatus may further include a cable for connecting to an external audio playback device such that the speakers are coupled to the external audio playback device instead of the microphone when the cable is coupled to the external audio playback device. Further, the apparatus may still further include an indicator light which is configured to display a first color when the microphone is active and to display a second color when the cable is coupled to the external audio playback device.

BRIEF DESCRIPTION OF THE DRAWINGS

The following detailed description, given by way of example and not intended to limit the present invention solely thereto, will best be understood in conjunction with the accompanying drawings in which.

DETAILED DESCRIPTION OF THE PREFERRED EMBODIMENTS

In the present disclosure, like reference numbers refer to like elements throughout the drawings, which illustrate various exemplary embodiments of the present invention.

Figure 1A:
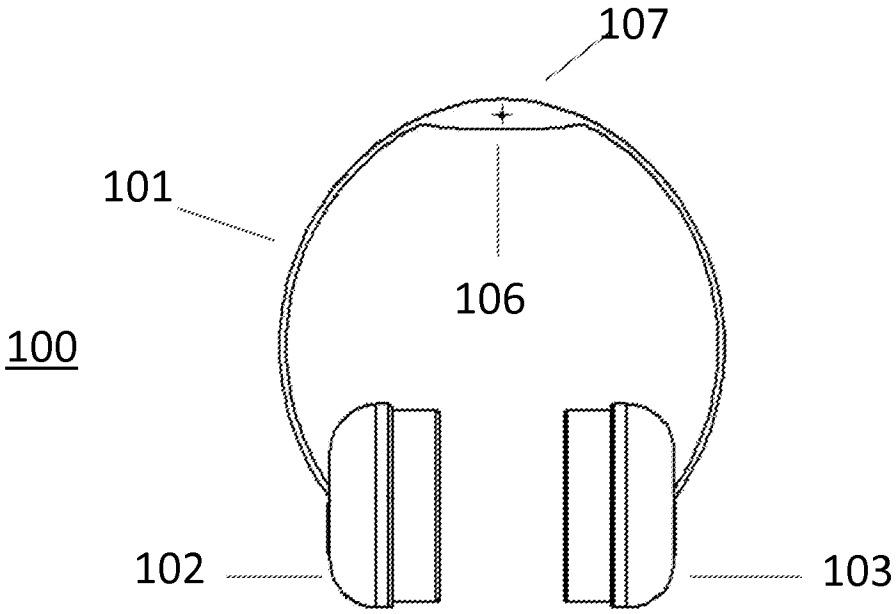
FIGS. 1A and 1B are diagrams of an embodiment of the present invention.
Figure 1B:
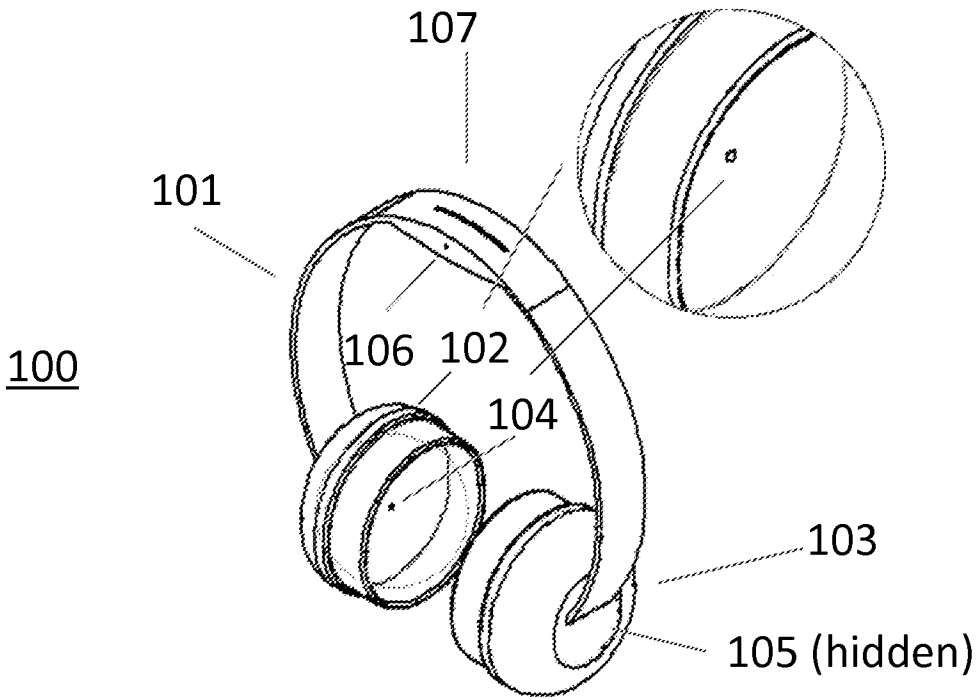

Referring now to the drawings and in particular to FIGS. 1A and 1B, a first preferred embodiment of the apparatus is shown. The apparatus 100 is fashioned as a set of wireless headphones or ear protection gear for a noisy work environment. Two ear cups 102 and 103 are joined by a flexible member 101. The ear cups 102, 103 create an air seal around the user's ear, but does not need to be sound proof or sound permeable, in order to isolate each ear from any changes in ambient air pressure. Small headphones/speakers 104 and 105 are integrated into each ear cup 102 and 103 and connected by wires to a unidirectional or multidirectional microphone 106, located on the top of the apparatus. Insulation around the wires maintains the air seal of the ear cup. A small light 107, such as an LED, is mounted on a visible place on the flexible member 101, e.g., the apex as shown in FIG. 1A, and is lit when apparatus 100 is properly transmitting any sounds captured by its microphone 106 to the headphones/speakers 104 and 105 on both ear cups 102 and 103. Microphone 106 may additionally be provided as an array of multiple microphones to improve sound capture and reliability. In addition, a number of LEDs 107 may be used to ensure visibility from many angles.

A power source, e.g., one or more batteries, is preferably integrated into the structure of the apparatus to provide power for sound transmission from the microphone 106 to the headphones/speakers 104 and 105, as well as lighting the LED 107. As one of ordinary skill in the art will readily recognize, the power source may alternatively be external, e.g., coupled to apparatus 100 via an inductive or wired connection. Microphone 106 is preferably active, including an internal amplifier. One of ordinary skill in the art will readily recognize that microphone 106 may alternatively be passive and a separate amplifier can be provided to amplify the signal of interest.

During normal operation, the microphone 106 captures sounds from the area surrounding the user and transfer such sounds unchanged to ear cups 102 and 103 using the headphones/speakers 104 and 105 integrated therein. LED 107 will light indicating to those around the user, in particular a cabin crew when apparatus 100 is used on an aircraft, that the apparatus 100 is operating properly and that the user can hear any instructions issued by the cabin crew.

Upon a disruption on the transmission of the surrounding sounds, either because of low or no battery power, malfunction of either headphones/speakers 104 or 105, microphone 106 or LED 107, or cuts or shorts on the wires connecting the various components, LED 107 will not light or go dark, indicating to the user and those around the user that it is no longer safe to wear the apparatus 100 (because the user is no longer able to hear ambient sounds due to the protection provided by ear cups 102 and 103).

In an alternative embodiment, apparatus 100 may be equipped with a built-in power source and a plastic strip similar to those found in battery-powered clocks and watches that is inserted between the power source and the internal electrical circuit to prevent activation of apparatus 100 prior to the first use and thereby limiting battery discharge before first use. The strip is not intended to be replaced, therefore leaving the device "on" until the battery discharges to a point where the apparatus 100 is no longer usable, making it usable for a period of time, say a long flight, but not beyond that. In another alternate embodiment, an on-off switch may be added to the electrical circuit in series with the power source to enable or disable the apparatus 100. A further embodiment enables the battery to be replaced and/or recharged, either by placing the battery on an external device similar to those used by some digital cameras, or adding a charging plug (e.g., mini-USB), an inductive charger, or solar cell(s) to the apparatus 100. This would make the apparatus 100 reusable over many flights.

In a further embodiment, a volume control may be added to the apparatus 100. However, the volume control (not shown) must only enable higher than normal settings, e.g., to help those with hearing difficulties. The volume setting may never be lowered below a normal setting, to ensure that the user may always hear the surrounding environment and may not, either deliberately or accidentally, cut off sound or lower it to a setting that effectively isolates the user from hearing the surrounding sound.

Figure 2A:
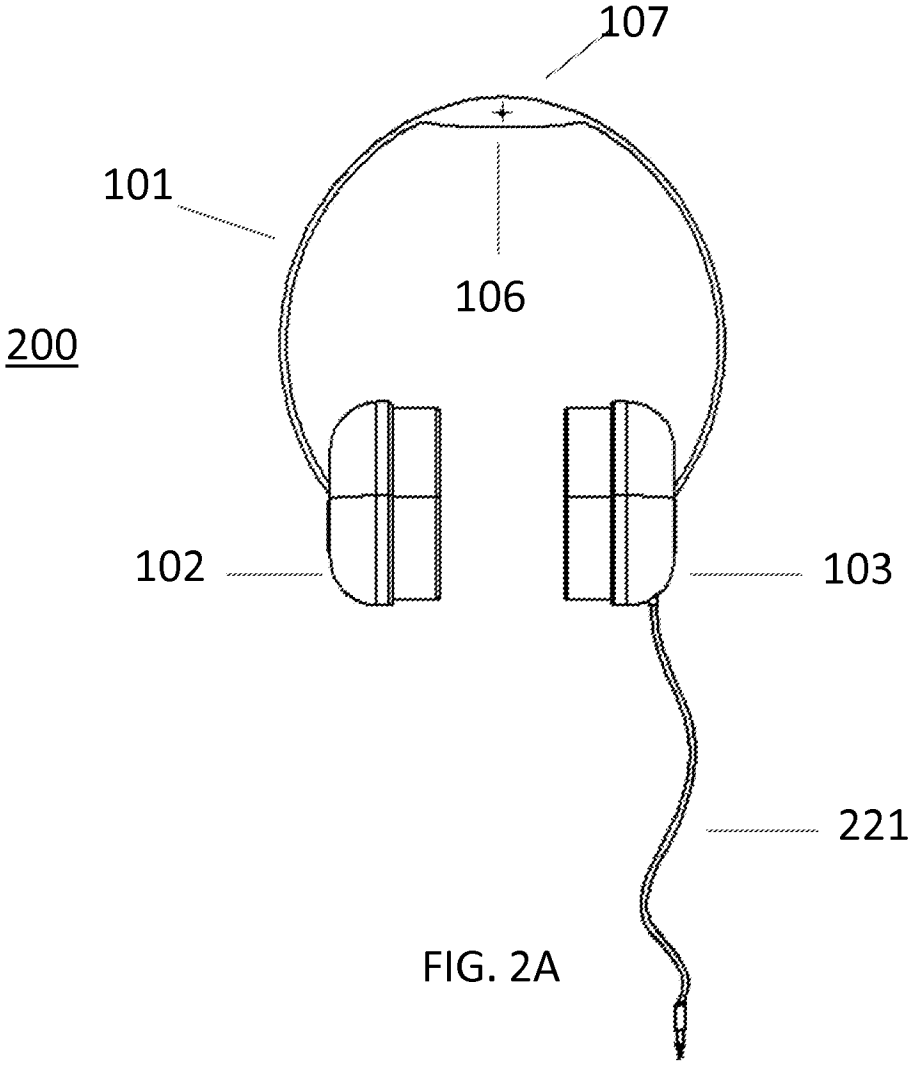
FIGS. 2A and 2B are diagrams of a further embodiment of the present invention.
Figure 2B:
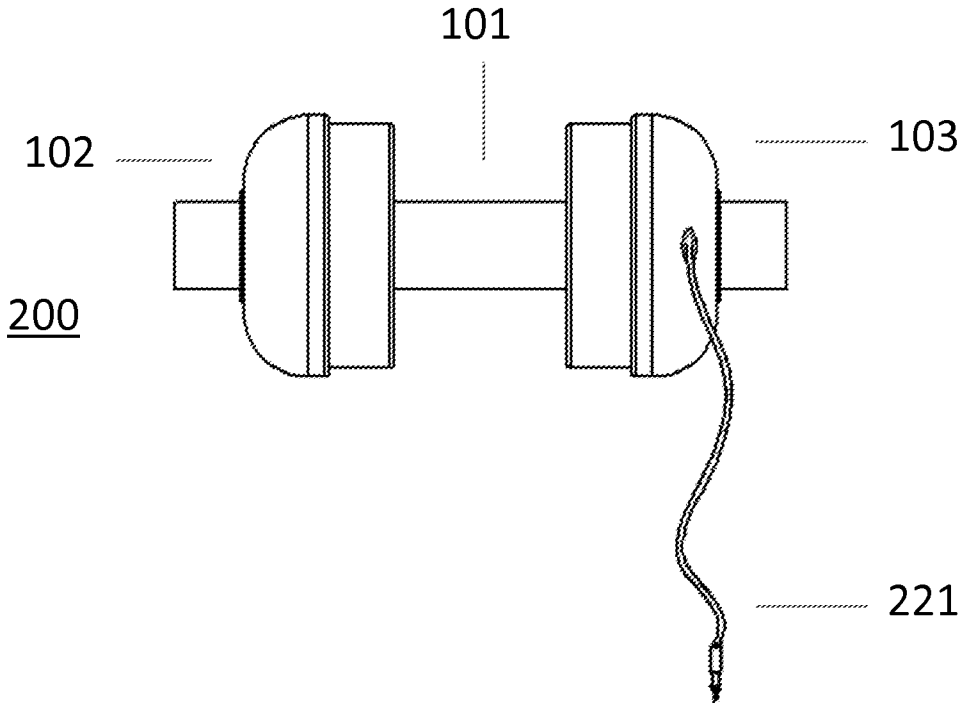

Referring now to FIGS. 2A and 2B, an alternative embodiment is shown which modifies apparatus 100 to allow for music listening and/or noise cancelling. Apparatus 200 features the addition of a corded connection 221, enabling the attachment of audio playback devices, such as MP3 players or other compatible digital or analog devices, as well as connecting to an aircraft's entertainment system. When this connection 221 is active, the apparatus 200 acts as a normal headset and the LED 107 may show a different color than when it is in normal operation, or be dark (off). In this manner, those around the user of apparatus 200, and in particular the cabin crew in an aircraft, can easily see the person may not be hearing their instructions. In an alternative embodiment, corded connection 221 may be replaced by a wireless connection, e.g., Bluetooth, Near Field Communication (NFC), WiFi, etc., to communicate with a separate audio playback device (or audiovisual playback device).

In an alternative embodiment, the apparatus 200 may feature a mode switch to select a noise-cancelling setting, which electronically masks background noise. Setting of the mode switch to noise-cancelling may be identified by a setting LED 107 to a different color or by turning the LED 107 off. The action taken in this mode may depend upon on the prevailing airline regulations.

Figure 3A:
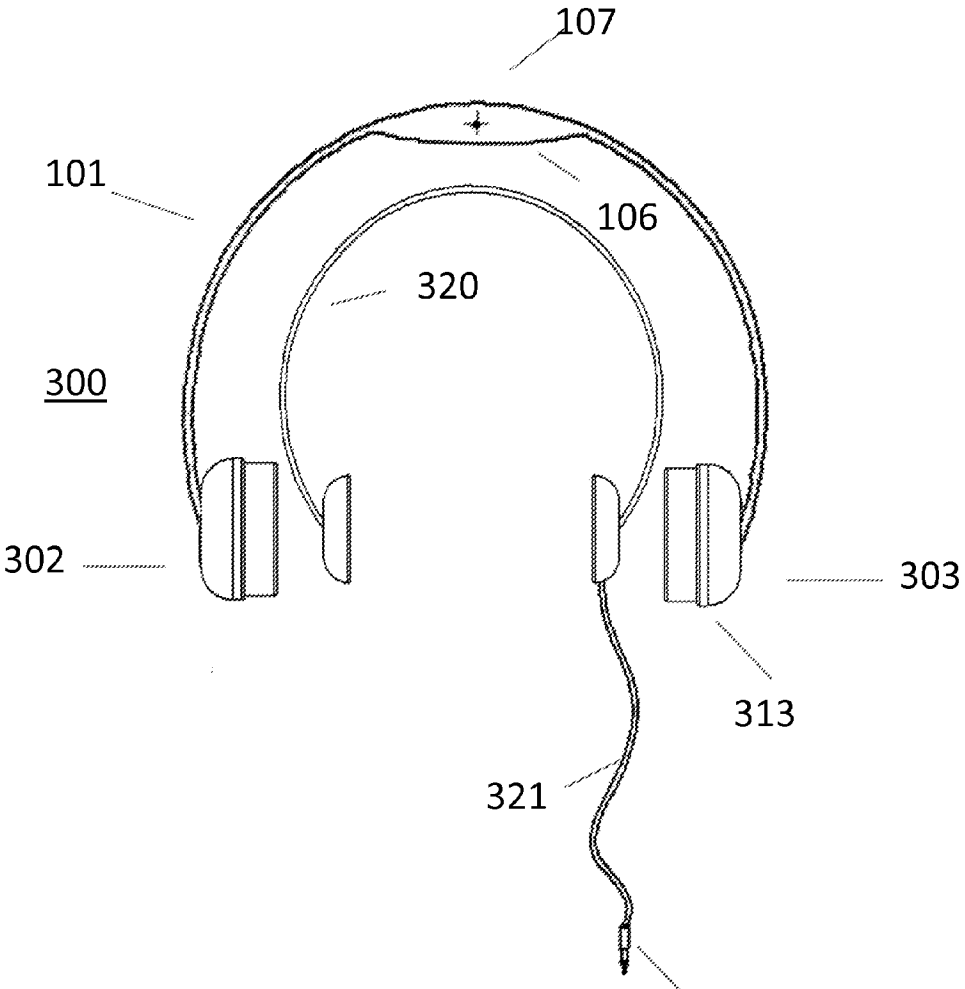
FIGS. 3A and 3B are diagrams of an alternative embodiment of the present invention
Figure 3B:
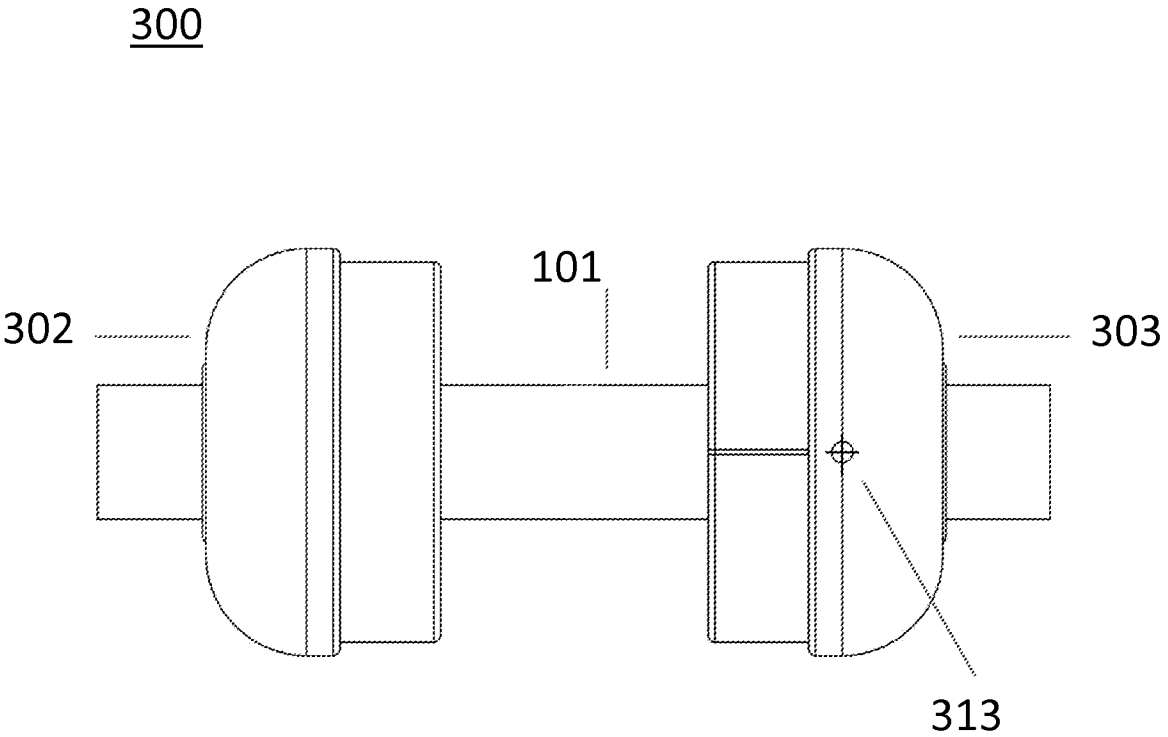
Figure 5:
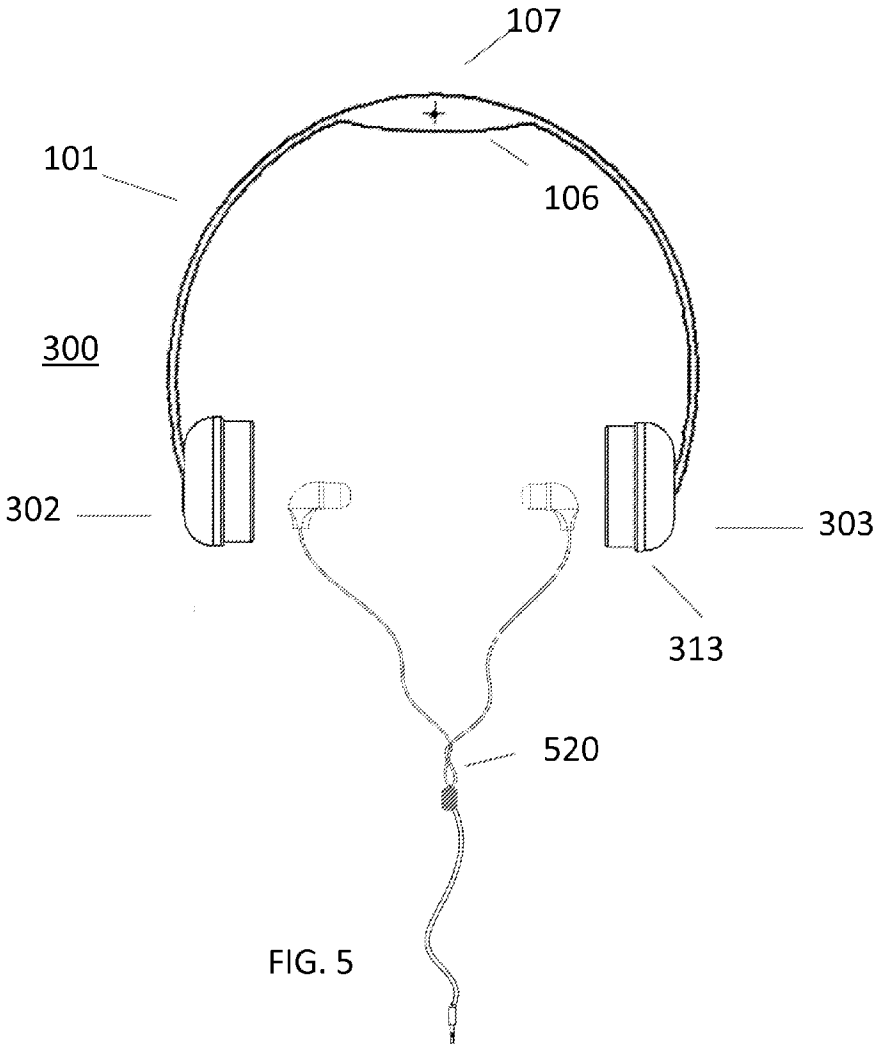
FIG. 5 is a diagram of a second variation to the embodiment of FIGS. 3A and 3B.

Referring now to FIGS. 3A and 5, apparatus 300 is shown fitted over a set of headphones 320 (FIG. 3A) or 520 (FIG. 5) used to listen to audio playback devices, such as MP3 players or other compatible digital or analog devices, as well as connecting to an aircraft's entertainment system via a corded connection 321 terminated with a male audio plug 312. For the purposes of this disclosure, the term "headphones" refer both to a device 320 that fits over the ears of a user and to a device 520 that includes portions which fit into an external portion of the ear canal of a user (e.g., ear buds). The apparatus 300 features ear cups 302, 303 which create an air seal around the headphone user's ears, as in the prior embodiments. Apparatus 300 also includes a female audio plug 313 that mates with male audio plug 312. When male audio plug 312 is plugged into female audio plug 313, the microphone 106 captures sounds from the user's surrounding area and transfers them unchanged to earphones 320 through the plugged connection. LED 107 will light indicating to those around the user, in particular the cabin crew, that the apparatus 300 is operating properly and its user can hear their instructions. If the male audio plug 312 is unplugged from the female audio plug 313, LED 107 becomes dark (off). In an alternative embodiment, corded connection 321 may be replaced by a wireless connection, e.g., Bluetooth, Near Field Communication (NFC), WiFi, etc.

Figure 4:
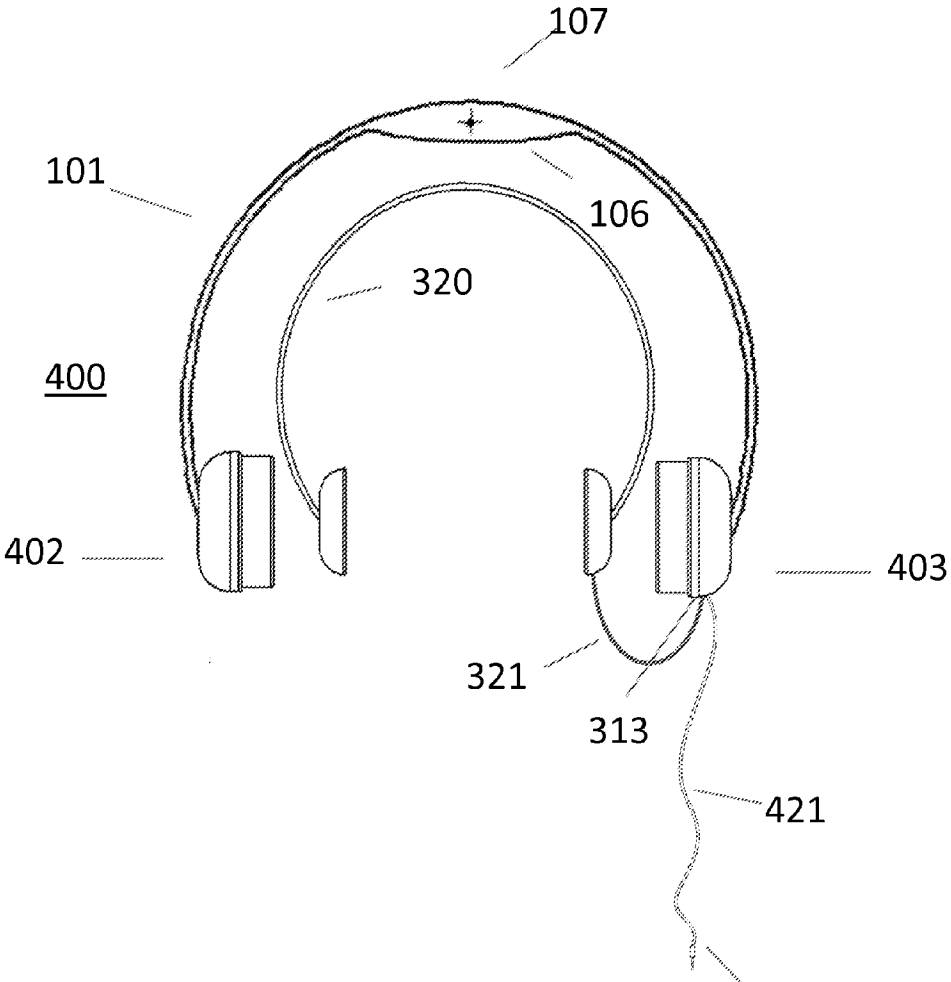
FIG. 4 is a diagram of a first variation to the embodiment of FIGS. 3A and 3B.

Referring now to FIG. 4, another alternative embodiment is shown in which an apparatus 400 is shown with ear cups 402, 403 fitted over a set of headphones 320 in the same manner as apparatus 300 in FIG. 3A. However, in this embodiment apparatus 400 includes a corded connection 421 terminated with a male audio plug 412 that can be used to couple to external audio playback devices. In operation, when male audio plug 312 (not shown in FIG. 4) is plugged into female audio plug 313 and no external connection is made with audio plug 412, microphone 106 captures sounds from the user's surrounding area and transfers them unchanged to earphones 320 through the corded connection 421. LED 107 will light indicating to those around the user, in particular the cabin crew, that the apparatus 300 is operating properly and its user can hear their instructions. However, when male audio plug 312 (not shown in FIG. 4) is plugged into female audio plug 313 and audio plug 412 is coupled to an external audio playback device, microphone 106 does not capture sounds from the user's surrounding area and instead the audio signal received from the audio playback device is passed to earphones 320 through the corded connection 421. LED 107 will either display an alternative color or become dark. If the male audio plug 312 is unplugged from the female audio plug 313, LED 107 becomes dark (off) as with the FIG. 3A embodiment.

Figure 6A:
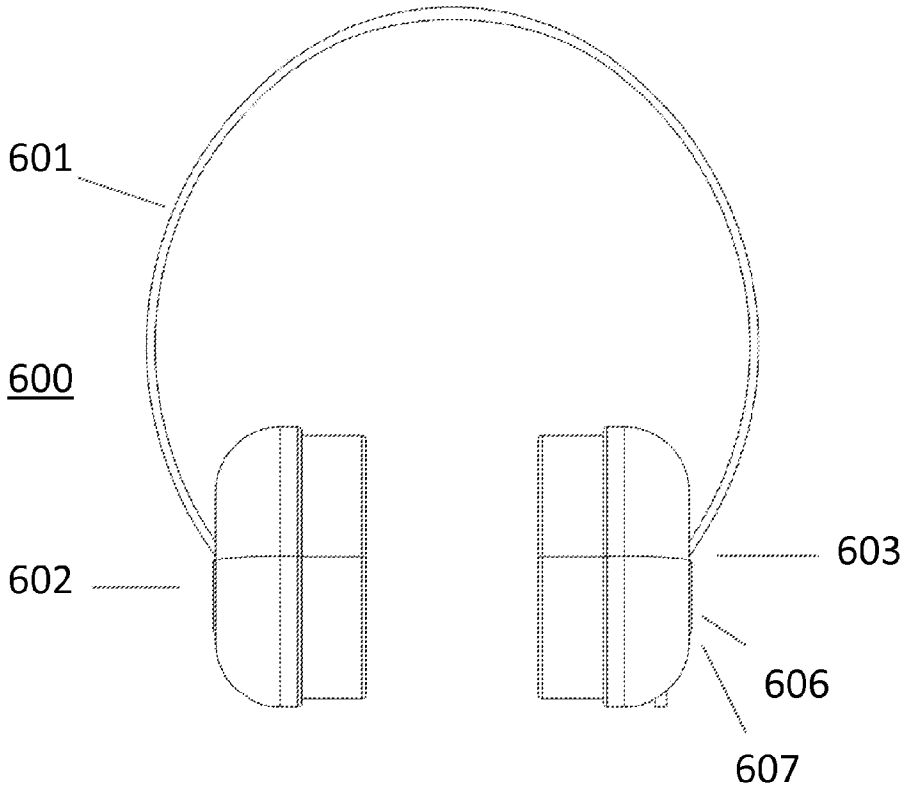
FIGS. 6A, 6B and 6C are diagrams of a variation of the embodiment of FIGS. 1A and 1B.
Figure 6B:
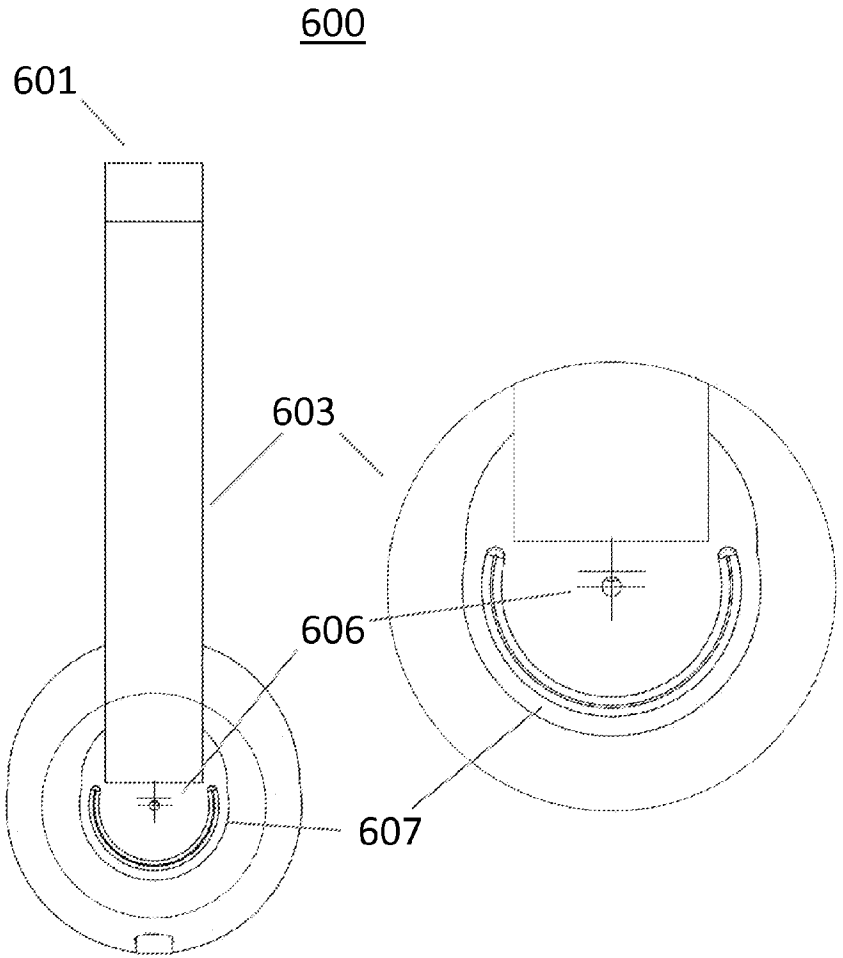
Figure 6C:
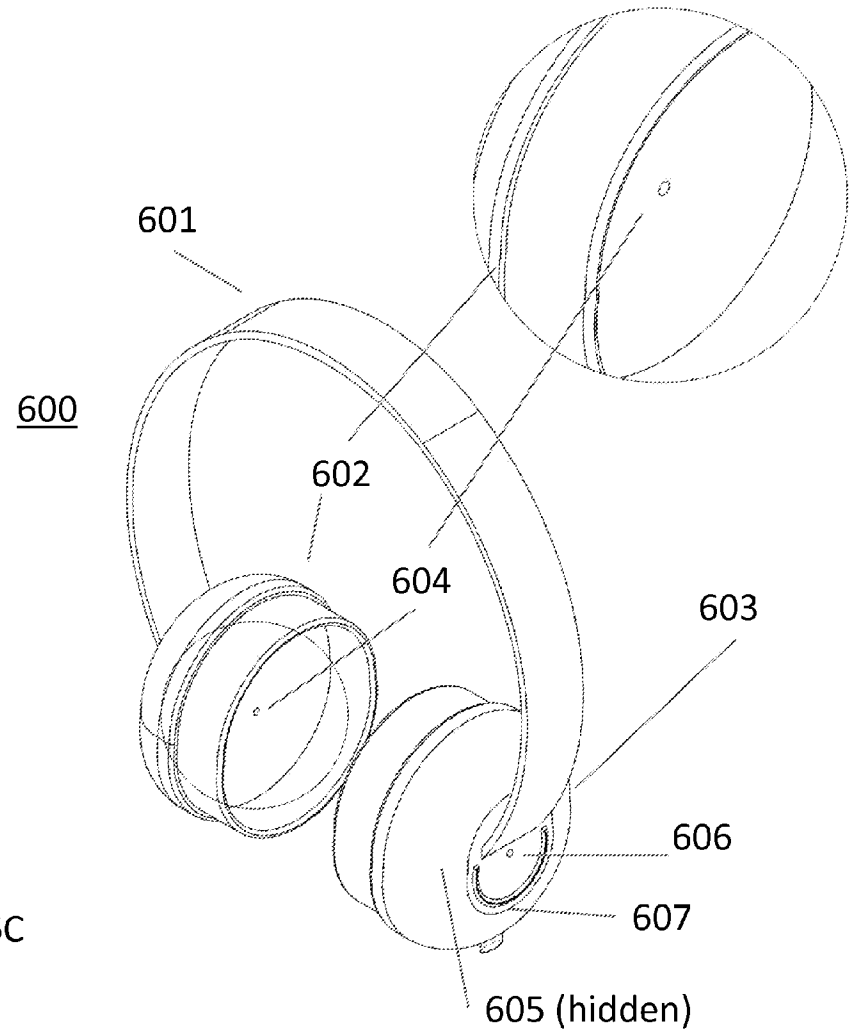
Figure 7:
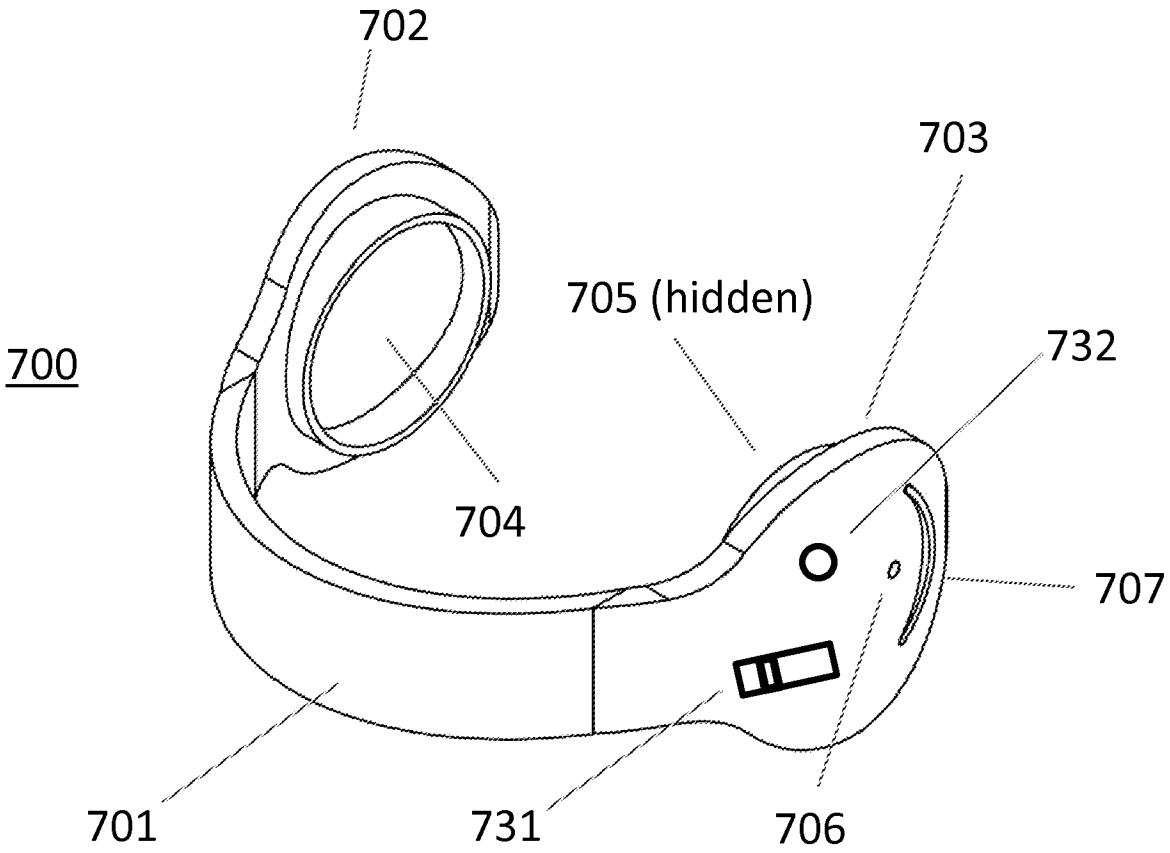
FIG. 7 is a diagram of a variation of the embodiment of FIGS. 1A and 1B which embeds the invention in a clothing accessory.

Referring now to FIGS. 6A, 6B and 6C, another alternative embodiment is shown in which apparatus 600 includes two ear cups 602, 603 joined by a flexible member 601 and which includes an LED 607 and microphone 606 mounted on an ear cup (e.g., ear cup 603 in FIG. 6A), instead of along flexible member 101 as in the prior embodiments. Each ear cup 602, 603 isolates the ear from ambient air pressure changes in the same manner as ear cups 102, 103 and each includes a respective internal speaker 604, 605. Positioning LED 607 and microphone 606 on an ear cup may provide certain manufacturing costs savings over the prior embodiments, as flexible member 601 could be an off-the-shelf part or at least a part used in common with other types of headphones, since no new functionality is required, other than routing of wires from one ear cup to the other (not shown in the Figures, but understood to one of ordinary skill in the art).

In a further embodiment, especially suitable for babies and young children, a digital memory and associated playback circuitry may be integrated into any of apparatus 100, 200, 300, 400 or 600, either fixed or replaceable (e.g., a micro-SD card), to store children's melodies, stories, or voice recordings (e.g., a parent talking or singing), in an appropriate sound volume setting. This may be particularly soothing for a child or infant, and help to tolerate the apparatus 100, 200, or 300 covering their ears. Since children and infants are not expected to follow crew instructions, but rather be assisted by adults, their relative insulation from outside sounds may be permissible. In a further embodiment, a switch may be used to couple microphone 106 to a recording circuit that records audio signals from the microphone into the integrated digital memory.

In all embodiments, the apparatus 100, 200, 300, 400 or 600 may be built into a child's hat, earmuffs, headband, or any other form factors which still accomplish the task of providing airtight ear cups, e.g., ear cups 102 and 103, containing headphones/speakers, e.g., speakers 104 and 105, and connected to a microphone 106 exposed to the surrounding sounds, with a LED 107 showing when the apparatus 100, 200, 300, 400 or 600 is working normally. For example, an earmuff product 700, e.g., a behind-the-ear earmuff clothing accessory, includes two ear cups 702, 703 joined by a flexible member 701. Ear cups 702, 703 function identically to the ear cups 102, 103 discussed above. Speakers 704, 705 are integrated into respective ear cups 702, 703, as with the embodiment shown in FIGS. 1A and 1B. Earmuff 700 also includes a microphone 706 and an indicator light 707 which provide the same functionality as microphone 106 and LED 107, respectively, as discussed above with respect to FIGS. 1A and 1B. Earmuff 700 also includes a volume control switch 732, and a slider switch 731. Slider switch 731 is used to set the current operating mode of the device, and may include setting such as recording via the microphone 706, playback of a recording, noise cancellation, ambient noise capture, "on" or "off."

Although the present invention has been particularly shown and described with reference to the preferred embodiments and various aspects thereof, it will be appreciated by those of ordinary skill in the art that various changes and modifications may be made without departing from the spirit and scope of the invention. It is intended that the appended claims be interpreted as including the embodiments described herein, the alternatives mentioned above, and all equivalents thereto.

What is claimed is:

1. An apparatus comprising:

a pair of ear cups, each ear cup including a speaker mounted on an internal portion thereof and configured to form an air pressure seal around an ear of a user when the apparatus is placed on the user;

a flexible member coupling the two ear cups and configured such that, when the apparatus is placed on the user, each ear cup completely covers an associated ear of the user and forms an air pressure seal around the associated ear;

a microphone electrically coupled to the speaker in each ear cup for transmitting ambient sound to the user when the apparatus is placed on the user; and an input for coupling to external headphones and wherein the microphone is configured to transmit ambient sound to the user via the external headphones when a cable for the headphones is coupled to the input.

2. The apparatus of claim 1, further comprising a cable for connecting to an external audio playback device and wherein the speakers are coupled to the external audio playback device instead of the microphone when the cable is coupled to the external audio playback device.

3. The apparatus of claim 2, further comprising an indicator light which is configured to display a first color when the microphone is active and to display a second color when the cable is coupled to the external audio playback device.

* * * * *